United States Patent [19]

Guerrini et al.

[11] 4,130,367

[45] Dec. 19, 1978

[54] CARTRIDGE FOR AN ENDLESS INKED RIBBON FOR PRINTING OFFICE MACHINES

[75] Inventors: Giampaolo Guerrini, Ivrea; Mario Trompetto, Mercenasco, both of Italy

[73] Assignee: Ing. C. Olivetti & C., S.p.A., Ivrea (Turin), Italy

[21] Appl. No.: 632,910

[22] Filed: Nov. 18, 1975

[30] Foreign Application Priority Data

Nov. 18, 1974 [IT] Italy ..... 70359 A/74

[51] Int. Cl.[2] ..... B41J 33/10

[52] U.S. Cl. ..... 400/195; 400/196

[58] Field of Search ..... 197/151, 154, 157, 168; 242/197

[56] References Cited

U.S. PATENT DOCUMENTS

| | | | |
|---|---|---|---|
| 3,490,671 | 1/1970 | Hladky | 197/168 UX |
| 3,726,381 | 4/1973 | Murphy | 197/168 |
| 3,728,963 | 4/1973 | Dowd | 197/151 X |
| 3,830,351 | 8/1974 | Cappotto | 197/168 |
| 3,871,507 | 3/1975 | Perry et al. | 197/168 X |
| 3,904,017 | 9/1975 | Frechette | 197/168 X |
| 3,918,569 | 11/1975 | Parker | 197/168 |
| 3,941,231 | 3/1976 | Matuck et al. | 197/151 |
| 3,974,906 | 8/1976 | Lee et al. | 197/168 |

FOREIGN PATENT DOCUMENTS

| | | | |
|---|---|---|---|
| 2136777 | 2/1973 | Fed. Rep. of Germany | 197/168 |
| 12870 of | 1914 | United Kingdom | 197/168 |
| 29235 of | 1914 | United Kingdom | 197/168 |

OTHER PUBLICATIONS

IBM Tech. Disc. Bulletin, G. Burgers et al., vol. 7, No. 12, May 1966, pp. 1212–1213.

IBM Tech. Disc. Bulletin, B. Gardineer, vol. 15, No. 2, Jul. 1972, p. 543.

*Primary Examiner*—Paul T. Sewell

[57] ABSTRACT

A cartridge for an endless inked ribbon for printing office machines comprises a container in which are disposed separating elements which define a storage zone. An endless inked ribbon is disposed in loops and is distributed at random in the storage zone. The inked ribbon passes from a slit to the exterior of the storage zone and through one aperture to the exterior of the container. A section of the inked ribbon is twisted through 180° to form a Möbius loop, by guide elements which localize the twisted section in a zone of the container outside the storage zone. The inked ribbon passes back into a container through a second aperture and returns to the interior of the storage zone through an opening thereof. At least one curved wall, adjacent to the slit, defines an housing for receiving any loop which have escaped from the slit for preventing a plurality of loops of the ribbon emerging simultaneously from the storage zone.

16 Claims, 5 Drawing Figures

CARTRIDGE FOR AN ENDLESS INKED RIBBON FOR PRINTING OFFICE MACHINES

BACKGROUND OF THE INVENTION

The present invention relates to a cartridge for an endless inked ribbon for typewriters and other printing office machines, comprising a container in which the ribbon is disposed in loops distributed at random and in which a section of the said ribbon is twisted through 180° to form a Möbius loop.

An inked-ribbon cartridge is known in which the inked ribbon is not disposed in random loops but is twisted in a Möbius loop and is guided by a number of rotatable rollers inside the cartridge. An inking roller is kept in contact with the ribbon for the inking thereof and one of the rollers, which is spring actuated, acts as a ribbon tensioner and keeps the ribbon under tension. A section of the ribbon is twisted through 180° and a wedge-shaped element bearing on the ribbon localises this section in a well-defined part of the cartridge and prevents the twisted section of ribbon being able to migrate to the section of the ribbon at which the striking action takes place. Owing to the presence of the inking roller, the rollers over which the ribbon runs and the ribbon tensioning roller, the cartridge is somewhat complicated and its cost is rather high.

Another inked-ribbon cartridge of the aforesaid type is also known in which the ribbon is disposed at random inside the cartridge and is unwound outside for a relatively long portion. Moreover, when the cartridge is mounted in the machine, the ribbon is twisted through 180° for a predetermined distance in its course outside the cartridge by means of a pair of pins of the machine to produce the twist necessary for the Möbius loop. With this arrangement there is the disadvantage that, in addition to the normal guides for the ribbon, guide surfaces for the twist are present on the machine and the mounting of the cartridge thereon proves to be more complicated.

SUMMARY OF THE INVENTION

The object of the present invention is to provide a cartridge for inked ribbon of the endless type disposed in random loops in a container and having a section twisted through 180° which is of relatively low cost and very simple to use.

According to the present invention there is provided a cartridge for an endless inked ribbon for printing office machines, comprising a container having a base and a cover and in which the ribbon is disposed in loops distributed at random and in which a section of the ribbon is twisted through 180° to form a Möbius loop, separating elements disposed in the container which define a storage zone in which the random loops are contained, and guide elements which localise the said section in a twisting zone of the container outside the storage zone.

BRIEF DESCRIPTION OF THE DRAWING

The invention will be described in more detail, by way of example, in the following description with reference to the accompanying drawing, wherein.

DESCRIPTION OF THE PREFERRED EMBODIMENT

Figure 1:
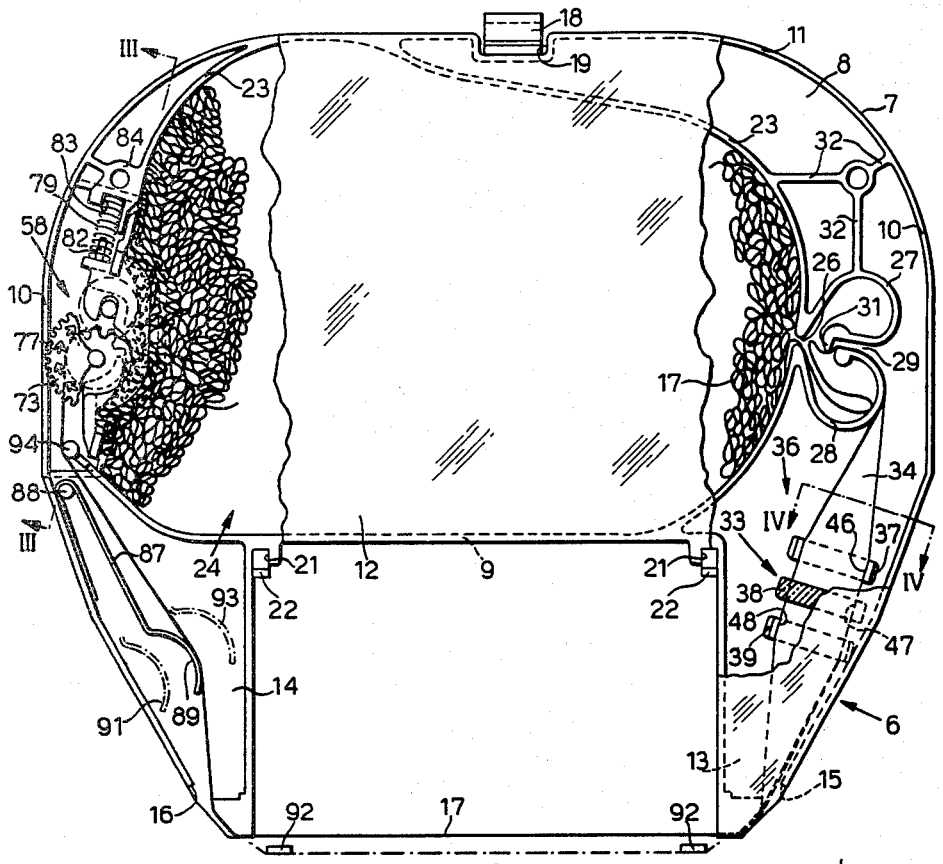
FIG. 1 is a partial plan view of an inked-ribbon cartridge embodying the invention.

Referring to FIG. 1, the cartridge 6 for an inked ribbon 17 comprises a container 7 of plastics material having a substantially parallelepipedal form but with radiused corners. The container 7 is composed of a base 8, a rear wall 9, two side walls 10, a front wall 11 and a cover 12. The cartridge 6 moreover has two suitably shaped hollow arms 13 and 14 projecting from the rear wall 9 and having at their ends two openings 15 and 16, respectively, for permitting the passage and guiding a section of the inked ribbon 17 outside the container 7. The cartridge 6 is held and fixed removably on a support, not shown in the drawings, of a printing office machine, for example by means of a spring tongue or catch 18. This tongue 18 is adapted to engage a slot 19 in the front wall 11 to keep the cartridge 6 arrested by means of two slots 21 in the rear wall 9 against two fixed stops 22 of the machine.

Separating elements 23 constituted by inner walls of the container 7 define a storage zone 24, in which the ribbon 17 is disposed in loops distributed at random. The storage zone 24 is of substantially oval form and is provided with a slit or cleft 26 for the exit of the ribbon 17.

The slit 26 is disposed substantially perpendicularly to the base 10 in such manner as to permit the ribbon 17 to issue parallel to the external portion of the ribbon 17 between the arms 13 and 14.

Two curved walls 27 and 28 of substantially circular section and connected to the slit 26 are spaced from one another so as to define a reentrant corridor 29 for the passage of the ribbon 17. The two curved walls 27 and 28 define two housings which are adapted to receive within their circular sections any loops of ribbon 17 which have possibly escaped from the slit 26. This prevents a plurality of loops emerging simultaneously from the storage zone 24. The curved wall 27 has a shoulder 31 disposed in front of the corridor 29, so that the ribbon 17 passing between the slit 26 and the corridor itself takes a substantially V-shaped course. Ribs 32 moreover connect the curved wall 27 and a part of the inner wall 23 with the side wall 10 of the cartridge 6.

Figure 4:
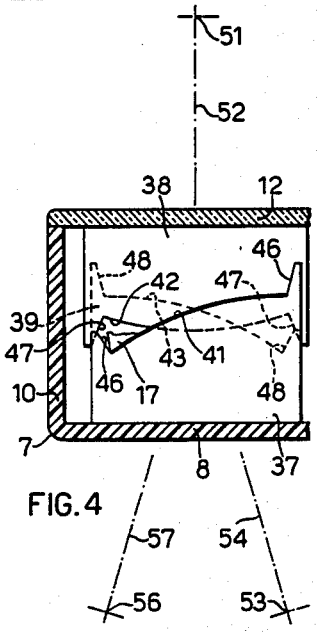
FIG. 4 is a partial section on the line IV—IV of FIG. 1 on a larger scale.

Guide elements 33 localise a section 34 of the ribbon 17, which is twisted through 180° to form a Möbius loop in a twisting zone 36 disposed between the separating elements 23 and the opening 15 of the arm 13. More particularly, the guide elements 33 are constituted by three ribs 37, 38 and 39 projecting alternately from the base 8 of the container 7 and from the cover 12. Each of the ribs 37, 38 and 39 (FIG. 4) comprises a guide edge 41, 42 and 43 adapted to co-operate alternately with one face and the other of the ribbon 17.

Each of the guide edges 41, 42 and 43 has the form substantially of a convex cylindrical sector and is defined laterally by two shoulders 46, 47 and 48, respectively, for guiding the edges of the ribbon 17 laterally. The intermediate rib 38 projecting from the cover 12 has the center 51 of the radius of curvature of the corresponding cylindrical sector disposed on a geometrical axis 52 (represented by a chain-dotted line) substantially perpendicular to the base 8 of the container 7. The remaining ribs 37 and 39, projecting from the base 8, are respectively adjacent in turn to the corridor 29 (FIG. 1) and the opening 15. Moreover, the center 53 (FIG. 4) of the radius of curvature of the cylindrical sector of the rib 37 is disposed on a geometrical axis 54 (represented by a chain-dotted line) inclined substantially towards the outside of the container 7, while the center 56 of the radius of curvature of the cylindrical sector of the rib 39 is disposed on a geometrical axis 57 (represented by a chain-dotted line) inclined substantially towards the inside of the container 7.

Figure 2:
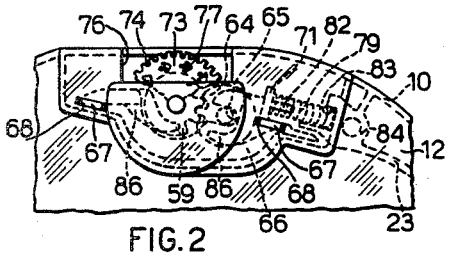
FIG. 2 is a partial view of a number of details of FIG. 1.
Figure 3:
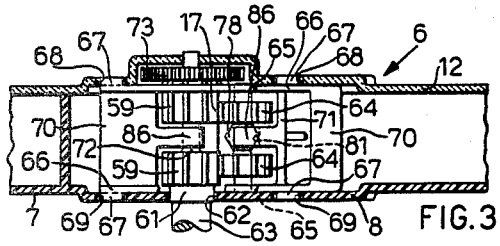
FIG. 3 is a partial section on the line III—III of FIG. 1.

The cartridge 6 (FIG. 1) is provided with an arrangement of gears 58 for causing the ribbon 17 to advance unidirectionally. These gears 58 comprise a first gear assembly 59 (FIG. 3) rotatable between an opening 62 in the base 8 and the cover 12 of the cartridge 6, and a second gear assembly 64 (FIG. 2) rotatable and oscillating in a pair of slots 65 of a support 66. The support 66 is slidably guided by means of two pairs of projections 67 in slots 68 in the cover 12 and in slots 69 (FIG. 3) in the base 8 of the container 7. The support 66 comprises two parallel plates by which the two slots 65 are formed and which are interconnected by two walls 70 and by a crosspiece 71.

The first gear assembly 59 is constituted by two like and coaxial gears, spaced from one another by a shaft or core 72, and a disc 73 having its milled periphery 74 (FIG. 2) projecting from a window 76 of the cover 12. The disc 73 can be manually rotated clockwise, as indicated by the arrows 77, for taking up the ribbon 17 (FIG. 1), therefore placing it under tension after the cartridge 6 has been mounted between the fixed stops 22 and the spring tongue or catch 18 of the machine. The first gear assembly 59 (FIG. 3) is moreover engageable through the medium of a sleeve 61 projecting from the base 8 by a driving shaft 63 of the machine itself.

The second gear assembly 64 is adapted to mesh with the first gear assembly 59 to nip a portion of the ribbon 17 and is constituted by two like and coaxial gears spaced from one another by a barrel-shaped shaft or core 78. A spring 79 (FIG. 2) holds a projection 81 (FIG. 3) of the support 66 against the core 78 to keep the gears 64 in mesh with the gear 59 substantially parallel to them, so that a constant force is applied on the two gears 64. The spring 79 (FIG. 2) is applied between a pin 82 of the crosspiece 71 of the support 66 and a seat 83 of an element 84 which connects the inner wall 23 and the side wall 10.

The support 66 moreover comprises a pair of lugs 86 which respectively embrace the shaft 72 (FIG. 3) and the barrel-shaped shaft 78 and have a guide profile projecting from the teeth of the gears 59 (FIG. 2) and 64 for conveying the ribbon 17 (FIG. 1) back towards the storage zone 24, without interference with the teeth outside the meshing zone, in a manner known per se. Moreover, the teeth of the gears 59 (FIG. 2) and 64 are substantially barrel-shaped to allow a sufficient force to be exerted for the pulling along of the ribbon 17 (FIG. 1) with a minimum radial component, such as to require a low load of the spring 79.

Finally, the cartridge 6 comprises a leaf spring 87 fixed on a pin 88 on the base 8 of the container 7 and adapted to adjust the tension of the inked ribbon 17 both when the cartridge 6 is mounted and the driving shaft 63 (FIG. 3) causes the ribbon 17 to advance and when the cartridge 6 is not mounted on the machine. In fact, during the stage of commencement of the feed of the ribbon 17, which is obtained by the rotation of the gears 59 and 64, the leaf spring 87 (FIG. 1) oscillates between a position 89 and a position 91 shown in chain-dotted lines, thus limiting the inertia of the ribbon 17 to the section between the two arms 13 and 14. On the other hand, on removing the cartridge 6 from the machine, the external portion of the ribbon 17 between the arms 13 and 14, which is represented by a chain-dotted line and normally guided by ribbon guides 92 indicated schematically in FIG. 1, is retrieved by the leaf spring 87, which places the ribbon 17 under tension and shifts from the position 89 to the position 93 indicated in chain-dotted lines.

After co-operating with the leaf spring 87, the ribbon 17 is conveyed towards the gears 58 by means of a cylindrical element 94. To cause the ribbon 17 to advance manually or to put it under tension, it is necessary to actuate the disc 73 manually, causing it to rotate in the direction of the arrows 77.

Figure 5:
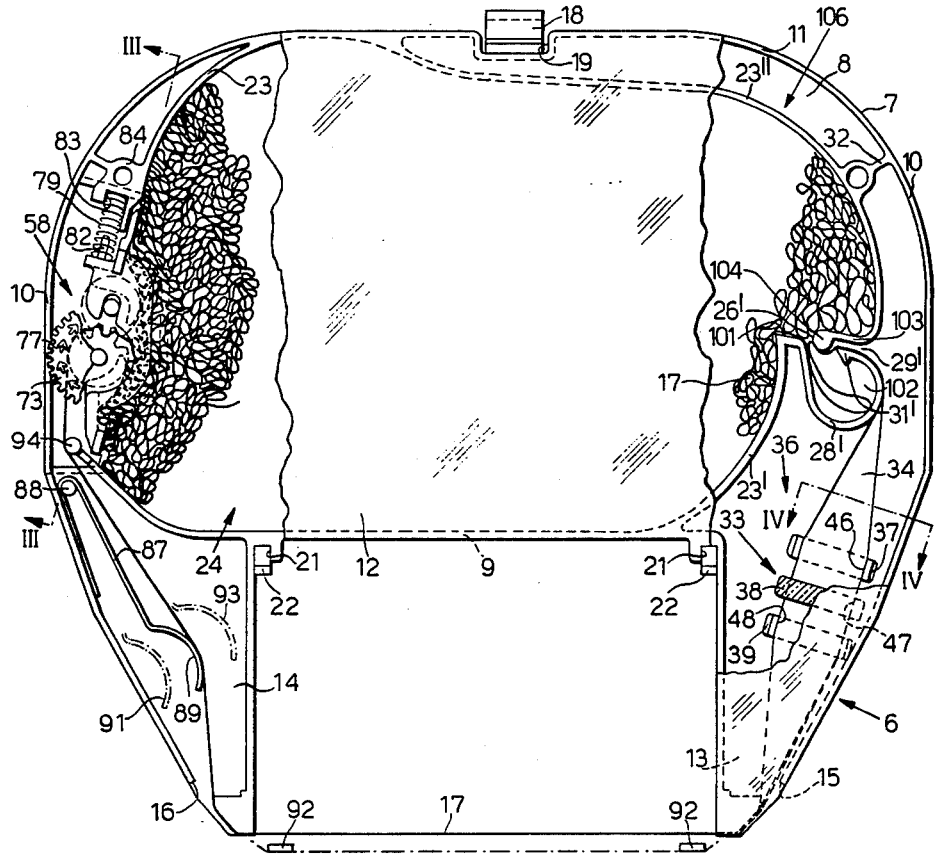
FIG. 5 shows a modified form of the cartridge of FIG. 1.

The above-described cartridge 6 is particularly adapted to be mounted on a printer of the type described in the U.S. Pat. No. 3,707,214 of Ponzano, assigned to the same assignee of this application herein incorporated by reference, for example on the carriage in substitution for the ribbon mounted on the frame of the machine 13. When used in this way, during the tabulating movements of the carriage, the loops of ribbon 17 adjacent the slit 26 may accumulate or pile up because of the acceleration of the carriage, thus tending to jam the loops. FIG. 5 shows a modification of the cartridge 6 of FIG. 1 which obviates the drawback which may arise from this particular application of the cartridge 6. In this modified construction, the separating elements indicated here by the references 23' and 23" which are disposed towards the side where the arm 13 is located have a configuration different from that of FIG. 1. More particularly, the element on surface 23' terminates in a shoulder 101 having a sharp corner or edge directed towards the storage zone 24 and a portion radiused towards a chamber 102 defined by a curved wall 28' similar to the wall 28 of FIG. 1.

The separating element 23" is constituted by a first curvilinear wall or surface substantially parallel to the front wall 11 and to the side wall 10 of the container 7, and by a second rectilinear wall or surface 103 substantially perpendicular to the side wall 10 and to the wall 23' and parallel to the direction of transverse acceleration of the cartridge 6 when it is mounted on a printer carriage. The wall 103 defines together with the curved wall 28' a corridor 29' for the passage of the ribbon 17 and terminates in a cylindrical element 104.

The cylindrical element 104 defines together with the shoulder 101 a slit 26' for the exit of the ribbon 17. The slit 26' is disposed substantially parallel to the side wall 10 in such manner as to permit the ribbon 17 to issue perpendicularly to the portion of the ribbon 17 which is between the arms 13 and 14 and, therefore, perpendicularly to the direction of acceleration of the cartridge 6.

The chamber or housing 102 defined by the curved wall 28' is adapted to receive any loops of ribbon 17 which may have escaped from the slit 26'. The curved wall 28' terminates in a shoulder 31' having a sharp edge or corner which is disposed at the beginning of the corridor or second slit 29'. The shoulder 31' and the shoulder 101 lie in the same plane, which is inclined with respect to the side wall 10, while the shoulder 104 is disposed beyond the plane in which the shoulders 31' and 101 are located, towards the chamber 102, in such manner that the ribbon 17 passing between the slit 26' and the corridor 29' takes a substantially V-shaped course.

The storage zone 24 of the modified constructional form retains the substantially oval shape of FIG. 1, but forms, at the element 23'' and the wall 103, a pocket indicated generally by the references 106, in which the ribbon 17 is disposed in loops distributed at random. During the accelerations of the carriage on which the cartridge 6 may be mounted, the loops of the ribbon 17 which are adjacent the slit 26' are arrested partly against the separating element 23' and partly against the separating element 23''. Since the shoulder 101 extends with its edge or corner beyond the slit 26', there is created in the pocket 106 a low loop density zone from which the ribbon 17 can be extracted freely.

It is understood that various modifications may be made both in the form and in the arrangement of the various elements and parts of the cartridge 6 without departing from the scope of the claims. For example, in the proximity of the slit 26 or 26' a rib may be provided on the cover 12 and a corresponding groove may be provided in the base 8. In this way, the loops of the ribbon 17 which are contained in the storage zone 24 are prevented by this rib and groove from all collecting towards the slit 26 or 26' and thus impeding the exit of the ribbon 17.

Another modification relates to the support 66 (FIG. 3), which may be integral with the base 8 of the container, as a result of which both the projections 67 and the slots 68 and 69 are eliminated. The second gear assembly is still guided by the slots 65, while the barrel-shaped shaft or core 78 is replaced by a shaft having a groove in its median portion in which there is housed one end of a hairpin spring applied between the shaft and the wall 10 of the container 7 and guided by a pin integral with the base 8 and which replaces the coil spring 79 (FIG. 1).

We claim:

1. An endless inked ribbon cartridge removably mountable in a printing machine of the type comprising a motive shaft for feeding the inked ribbon; said cartridge including a container having a bottom wall and a top wall; an endless inked ribbon disposed in loops and distributed at random in the interior of said container; a first gear assembly having a shaft rotatably mounted in said container between said bottom and said top walls; a connection portion removably engageable with said motive shaft for being driven thereby; a second gear assembly rotatably mounted in front of said first gear assembly and comprising two gears fixed on a common shaft, and two projections projecting outside said two gears; spring means urging said second gear assembly toward said first gear assembly perpendicular to said shaft to nip a portion of said inked ribbon between said first gear assembly and said two gears for feeding the inked ribbon in response to the driving of said motive shaft; slot means adjacent said bottom and said top walls for slidably engaging said two projections and so oriented as to provide movement of said second gear assembly toward and away from said first gear assembly along a plane coplanar to the shaft of said first gear assembly through different inclinations of said two gears with respect to said first gear assembly; and means pivotally connecting said spring means to said common shaft for uniformly distributing the force of said spring means to each of said two gears whatever the inclination of said two gears with respect to said first gear assembly along said plane, wherein said common shaft comprises two surfaces intermediate said two gears which converge toward one another, and said connecting means comprises an element urged by said spring means and bearing on said common shaft intermediate said two gears.

2. An endless inked ribbon cartridge removably mounted on a carriage of a printing machine; said carriage being movable with a transverse acceleration along a printing line to print at a printing point; said endless inked ribbon cartridge comprising a container comprising separating elements in the interior thereof defining a storage zone; said separating elements having an opening and a slit; an endless inked ribbon disposed in loops distributed at random in said storage zone; feeding means for feeding the ribbon out of said storage zone through said slit to the exterior of said storage zone past the printing point of the machine, and then through said opening back into said storage zone; said separating elements comprising a first and a second part defining first and second surfaces substantially perpendicular to a plane through said printing line and in opposed relationship to one another and located adjacent to said slit for arresting the loops of ribbon urged toward said slit in response to the transverse acceleration of said cartridge along the printing line, and a third part having a third surface oriented substantially perpendicular to said first and second surfaces and defining a low loop density space in said storage zone; said slit being defined by said third surface and one of said first and second surfaces and being oriented substantially perpendicularly to the direction of transverse acceleration of said cartridge, wherein said container further comprises separating walls disposed in the interior of said container adjacent to said slit and defining a second slit, and at least one housing between said slits for receiving any loops escaping from said slit during the transverse acceleration of said cartridge, and wherein said third part of said separating elements, said housing and said second slit define a corridor for the passage of said inked ribbon; a shoulder of said third part disposed between said slit and said second slit so that said inked ribbon passing between said slit and said corridor takes a substantially V-shaped course.

3. A cartridge for an endless inked ribbon for printing machines including: a container having a bottom wall, a rear wall and two arm members projecting from said rear wall, each of said two arm members having an aperture; separating walls disposed in the interior of said container for defining a storage zone therein, said separating walls having interruptions therein defining an opening and a slit substantially perpendicular to said bottom wall; an endless inked ribbon disposed in loops distributed at random in said storage zone wherein ribbon surfaces lie in planes substantially perpendicular to said bottom wall, said endless inked ribbon extending through said slit to the exterior of said storage zone and through the aperture of one arm of said arm members to the exterior of said container and returning to the interior of said container through the aperture of the other arm of said arm members, said ribbon returning to the interior of said storage zone through said opening; roller means located adjacent to said opening and engaging said ribbon to feed said ribbon into said storage zone; and guide elements engageable with said inked ribbon for gradually twisting a section thereof through 180° to form a Möbius loop and localizing said section in a twisting zone of said container located outside of said storage zone between said slit and the aperture of said one arm, when the ribbon is fed by said roller means, said guide elements comprising: a first guide adjacent to said slit for engagement with one surface of the ribbon to gradually twist said ribbon so that said one surface is intermediate a plane substantially parallel to said bottom wall and a plane perpendicular thereto; a second guide adjacent to said first guide for engagement with the other surface of said ribbon for twisting said ribbon so that said one surface is substantially parallel to the plane of said bottom wall and said ribbon has been twisted substantially 90°; and a third guide adjacent the aperture of said one arm for engagement with said one surface of said ribbon for reorienting said ribbon so that said one surface is intermediate the plane of said bottom wall and a plane perpendicular to said bottom wall and twisted more than 90° so that said ribbon when it passes through said aperture has been twisted 180°, and wherein said container further comprises a cover and said guide elements comprise ribs projecting alternately from said bottom wall and said cover and having guide edges for guiding alternately the opposed surfaces of said ribbon and lateral shoulders for guiding the edges of said ribbon; said guide edges having substantially convex cross-section.

4. A cartridge according to claim 3 wherein said first, second and third guides are substantially aligned with respect to the aperture of said one arm.

5. A cartridge according to claim 3, wherein said container further comprises separating means disposed in the interior of said container adjacent said slit and defining a loop storage zone therein for receiving any loops which have escaped from said slit and means for preventing a plurality of loops from emerging simultaneously from said loop storage zone; said loop storage zone having an external portion on which said one surface of the ribbon bears.

6. A cartridge according to claim 5 wherein said container has a substantially parallelepipedal form and comprises two side walls; said arm members supporting a portion of said endless ink ribbon between said apertures externally of said container and substantially perpendicular to said bottom wall; said loop storage being so disposed that said ink ribbon exiting therefrom is substantially perpendicular to said bottom wall and extends up to the aperture of said one arm substantially perpendicularly to said external portion of said ribbon.

7. A cartridge according to claim 3, wherein said second guide projects from said cover and the center of the radius of curvature of the convex cross-section is disposed on a straight line substantially perpendicular to said bottom wall, wherein said first guide projects from said bottom wall and the center of the radius of curvature of the convex cross-section is disposed on a straight line inclined toward the outside of said container, and wherein said third guide projects from said bottom wall and the center of the radius of curvature of the convex cross-section is disposed on a straight line inclined toward the inside of said container.

8. A cartridge according to claim 5, wherein said separating walls comprise inner walls of said container and said separating means comprise at least one curved wall adjacent to said slit further comprising a corridor defined by one of said inner walls with said curved wall; and a shoulder disposed between said slit and said loop storage zone, and wherein the ink ribbon passing between said slit and said corridor takes a substantially V shaped course.

9. An endless inked ribbon cartridge removably mounted on a carriage of a printing machine; said carriage being movable with a transverse acceleration along a printing line to print at a printing point; said endless inked ribbon cartridge comprising a container comprising in the interior thereof a storage zone having an opening and a slit; said storage zone being defined by an inner wall comprising two portions substantially parallel to the printing line; an endless inked ribbon disposed in loops distributed at random in said storage zone; feeding means for feeding the ribbon out of said storage zone through said slit to the exterior of said storage zone past the printing point of the machine, and then through said opening back into said storage zone; and means for causing a free extraction of the ribbon from the storage zone by said feeding means, when the cartridge is subject to said transverse acceleration, said means for causing a free extraction of the ribbon comprising first and second surfaces including curvilinear portions joined to the portions of said inner wall parallel to said printing line, respectively, and two portions substantially perpendicular to said printing line and offset relative to one another, said first surface ending with a shoulder, and a third surface connected to said second surface substantially perpendicular thereto and located in a position substantially centered with respect to the portions of said inner wall parallel to the printing line, said third surface being oriented toward said shoulder, said slit being defined between said third surface and said shoulder at a substantial distance from the inner wall of the storage zone, with said shoulder being disposed at one side with respect to said third surface and extending beyond said slit for causing said first surface to arrest the loops of ribbon urged toward said slit in response to the transverse acceleration of said cartridge along the printing line, so that said first, second and third surfaces define a low loop density space in a central portion of said storage zone from which the ribbon is freely extracted.

10. A cartridge according to claim 9, wherein said container further comprises separating walls disposed in the interior of said container adjacent to said slit and defining a second slit and at least one housing between said slits for receiving any loops escaping from said slit during the transverse acceleration of said cartridge.

11. A cartridge according to claim 10, wherein said container has a substantially parallelepipedal form and comprises two arms, each said arm having an aperture at an end thereof: a portion of said inked ribbon extending through said second slit to the exterior of said housing and through the aperture of one of said arms to the exterior of said container; and guide elements disposed between said second slit and the aperture of said one arm and engageable with said inked ribbon for gradually twisting said portion of said inked ribbon between said second slit to said aperture through 180° to form a Möbius loop.

12. A cartridge according to claim 11, wherein said container further comprises a base and a cover; said guide elements comprising ribs projecting alternately from said base and from said cover; said ribs having guide edges for cooperating alternately with one face and then the other face of said inked ribbon.

13. A cartridge according to claim 9, wherein said first and second surfaces are offset in directions both substantially parallel to and substantially perpendicular to said printing line, and said shoulder and said third surface extending from adjacent ends of said first and second surfaces, respectively, in a direction substantially parallel to said printing line to form said low loop density space immediately adjacent said shoulder and said third surface in front of said slit.

14. An endless inked ribbon cartridge according to claim 9, wherein said container further comprises guide elements engageable with said inked ribbon for gradually twisting a section thereof through 180° to form a Möbius loop and localizing said section in a twisting zone located outside said storage zone, said guide elements comprising: a first guide located adjacent to said slit and guiding one surface of said ribbon from an orientation substantially perpendicular to said bottom wall to an orientation at an angle between the perpendicular plane and a plane substantially parallel to said bottom wall; a second guide adjacent said first guide engaging the other surface of said ribbon for twisting said ribbon to a reoriented position substantially parallel to said bottom wall; and a third guide adjacent to said second guide and engaging said one surface of said ribbon for gradually further twisting said ribbon to a reoriented position at an angle intermediate between the parallel plane and a plane perpendicular to said bottom wall whereby said ribbon is twisted through 180°.

15. An endless inked ribbon cartridge removably mountable in a printing machine of the type comprising a motive shaft for feeding the inked ribbon; said cartridge including a container having a bottom wall and a top wall; an endless inked ribbon disposed in loops and distributed at random in the interior of said container; a first gear assembly having a shaft rotatably mounted in said container between said bottom and said top walls; a connection portion removably engageable with said motive shaft for being driven thereby; a second gear assembly rotatably mounted in front of said first gear assembly and comprising two gears fixed on a common shaft, two projections projecting outside said two gears and a portion of said common shaft intermediate said two gears; spring means urging said second gear assembly toward said first gear assembly to nip a portion of said inked ribbon between said first and said second gear assemblies for feeding the inked ribbon in response to the driving of said motive shaft; slot means adjacent said bottom and said top walls for slidably engaging said two projections of said two gears and so oriented as to provide movement of said second gear assembly toward and away from said first gear assembly along a plane coplanar to the axis of said first gear assembly; and means connecting said spring means to the intermediate portion of said common shaft for uniformly distributing the force of said spring means to said second gear assembly, thereby allowing small oscillations of said two gears with respect to said first gear assembly along said plane, and wherein said portion intermediate said two gears is formed as a barrel, and further comprising rectilinear guides in said bottom and top walls parallel to the axis of said first gear assembly, and a support, slidable along said guides toward and away from said first gear assembly; said slot means being in said support; said interconnecting means comprising a portion of said support engaged by said spring means and a projection of said support for cooperating with the barrel portion of said common shaft for holding said two gears in mesh with said first gear assembly under the urging of said spring means.

16. A cartridge according to claim 15, wherein said first gear assembly comprises two other like and coaxial gears having teeth respectively in engagement with teeth of the two gears of said second gear assembly and another common shaft connecting said two second gears; said support comprising a pair of lugs for respectively embracing said barrel portion and said other common shaft and a guide profile outside said teeth of said one and other gears for conveying said inked ribbon toward the interior of said container.

* * * * *